United States Patent [19]

Thaler

[11] 4,230,920

[45] Oct. 28, 1980

[54] GAS-BLAST SWITCH

[75] Inventor: Richard Thaler, Unterentfelden, Switzerland

[73] Assignee: Sprecher & Schuh AG, Aarau, Switzerland

[21] Appl. No.: 962,217

[22] Filed: Nov. 20, 1978

[30] Foreign Application Priority Data

Mar. 30, 1978 [CH] Switzerland ..... 3404/78

[51] Int. Cl.[3] ..... H01H 33/88

[52] U.S. Cl. ..... 200/148 A; 200/150 G

[58] Field of Search ..... 200/148 A, 150 G, 148 R

[56] References Cited

U.S. PATENT DOCUMENTS

| | | | |
|---|---|---|---|
| 2,459,599 | 1/1949 | Strom | 200/148 A |
| 3,524,958 | 8/1970 | Frink | 200/148 A |
| 3,739,125 | 6/1973 | Noeske | 200/150 G |
| 3,987,261 | 10/1976 | McConnell | 200/150 G |
| 4,182,942 | 1/1980 | Koyanagi et al. | 200/148 A |

*Primary Examiner*—Robert S. Macon

*Attorney, Agent, or Firm*—Werner W. Kleeman

[57] ABSTRACT

Within a gas tight insulating housing of a gas-blast switch there are arranged a fixed contact surrounded by a blast chamber, a movable contact and a blast nozzle movable together with said movable contact. The blast nozzle is connected to a pump device containing a pump cylinder movable along with the movable contact. The pump cylinder is displaceable upon a stationary piston. Means are coupled with the pump cylinder and which means, during the course of the cut-off stroke of the gas-blast switch, are impinged by the extinguishing or quenching gas heated by the arc and augment the operation of the pump device, and thus, the cut-off movement. The means coupled with the pump cylinder incorporate an impact plate which bridges the substantially jacket or shell-shaped blast chamber between the pump cylinder and the inner wall of the insulating housing preferably up to the region of a ring-shaped or annular gap. The pressure wave emanating from the expanding, heated extinguishing gas which is preferably deflected by deflection blades impinges the impact plate which, in turn, augments the cut-off movement by means of the pump cylinder.

7 Claims, 1 Drawing Figure

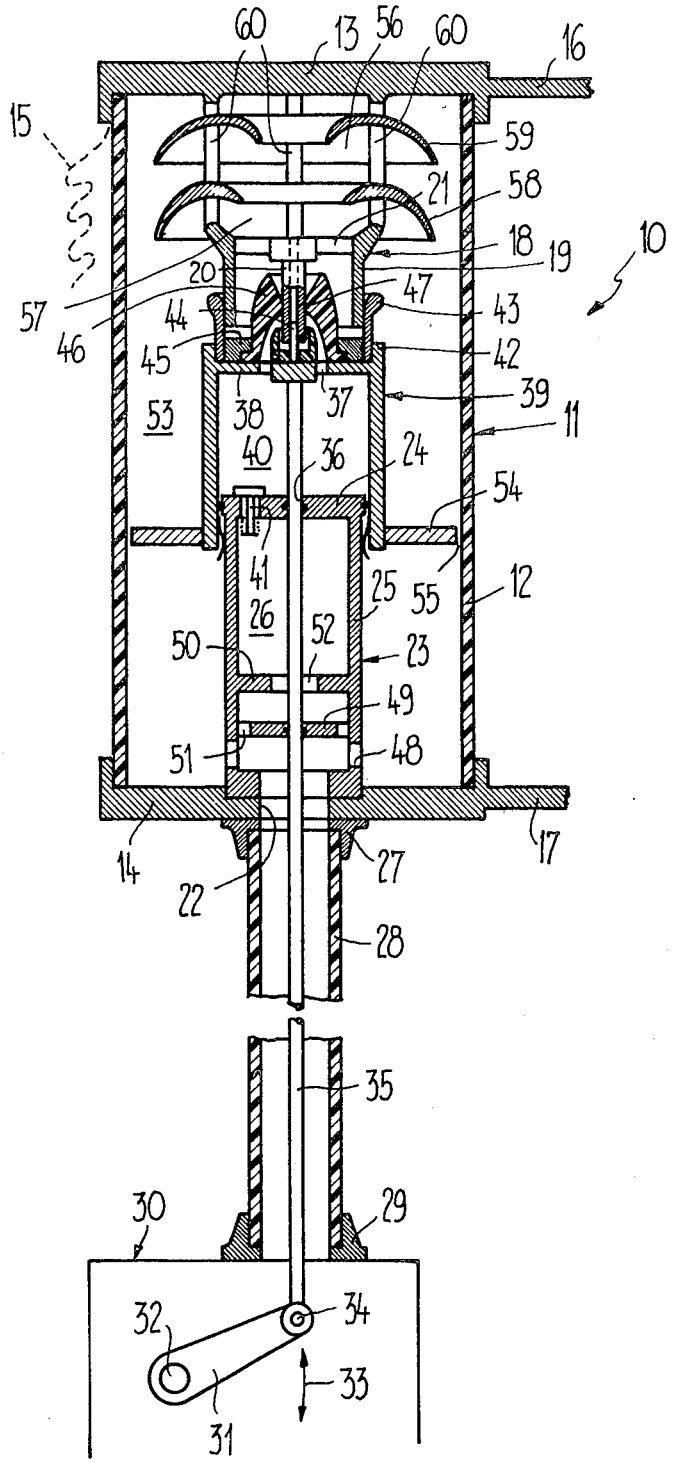
60
13
56
60
16
15
59
21
58
18
19
10
20
47
57
44
43
46
45
42
39
53
38
37
11
40
36
24
54
41
25
55
12
26
52
50
23
49
51
48
14
27
17
22
28
35
30
29
32
34
33
31

GAS-BLAST SWITCH

BACKGROUND OF THE INVENTION

The present invention relates to a new and improved constructon of a gas-blast switch.

The gas-blast switch of the invention is of the type comprising a gas tight insulating housing within which there is arranged a fixed contact surrounded by a blast chamber and a movable contact as well as a blast nozzle movable along with the movable contact and connected with a pump device. The pump device comprises a pump cylinder movable together with the movable contact. This pump cylinder is displaceable upon a stationary piston. Means are coupled with the pump cylinder and are impinged, during the course of the cut-off stroke of the gas-blast switch by the pressurized gas heated by the arc, in order to augment the pump stroke of the pump device.

A heretofore known gas-blast switch of this type, as disclosed in FIGS. 3*a* to 3*c* of West German patent publication No. 2,620,675, is constructed in the following manner. The pump cylinder is structured as a thin wall extension of the blast nozzle at the inlet side. This blast nozzle is closed in the cut-on or switching-on position by the fixed contact and thus in conjunction therewith forms the floor of the pump cylinder. The movable contact constructed as a continuous open tube is coaxially arranged internally of the thin wall projection or extension of the blast nozzle and fixed thereto by means of struts, so that between the extension or projection and the movable contact there remains free a jacket space or compartment forming the pump chamber. Engaging into this pump chamber at its one side is the stationarily supported pump piston which centrally has a throughpassage for the movable contact. At the end of the extension of the blast nozzle there is attached a further cylinder havng a larger internal diameter and which is displaceable upon a flange formed at the other side of the pump piston and radially protruding therefrom.

Now if during the cut-off movement the movable contact and together therewith the blast nozzle and the pump cylinder along with the further cylinder are moved away from the fixed contact element, then initially the movable contact disengages from the fixed contact, thereby drawing an arc, and at the same time the pump piston displaces extinguishing gas out of the pump chamber. The extinguishing or quenching gas blows the arc and initially can only escape through the movable contact element into the further cyllinder within which there thus occurs a pressure increase augmenting the cut-off movement. However, as soon as during the course of the cut-off movement the blast nozzle is also freed by the fixed contact, then not only does the extinguishing gas, expelled out of the pump chamber, no longer flow through the movable contact into the further cylinder, but the heated extinguishing gas collected therein at increased pressure again expands over the movable contact. Both gas streams, namely that of the fresh extinguishing gas emanating from the pump chamber and that of the immediately prior so-to-speak "contaminated" extinguishing gas emanating from the further cylinder now flow by means of the blast nozzle into the blast chamber. However, as a result thereof there also is interrupted the previous assistance of the cut-off movement, i.e., the drive brought about by the heated extinguishing gas, and furthermore, the arc is also blown with gas which just previously already has blown the arc and therefore its original extinguishing and cooling properties have been temporarily impaired.

SUMMARY OF THE INVENTION

Hence, with the foregoing in mind the present invention aims at the provision of a new and improved construction of a gas-blast switch of the previous mentioned type wherein the gas heated by the arc, firstly augments the cut-off movement during the entire cut-off stroke, and secondly, does not blow the same arc.

Now in order to implement these objects and others which will become more readily apparent as the description proceeds, the proposed gas-blast switch of the invention contemplates that the means coupled with the pump cylinder comprise an impact plate secured to the periphery thereof and radially protruding therefrom.

With the proposed switch the pressure wave arising during the cut-off or switching-off operation in the blast chamber impinges at the impact plate, which, in turn, augments the cut-off movement and this movement, in turn, as long as it is occurring, causes a displacement of fresh gas out of the pump chamber.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE shows a schematic longitudinal sectional view through a gas-blast switch and the drawing should not be considered to be to scale.

DETAILED DESCRIPTION OF THE PREFERRED EMBODIMENTS

Describing now the drawing, the illustrated exemplary embodiment of gas-blast switch 10 will be seen to possess an insulating housing 11 which, in turn, is constructed from a substantially, tubular-shaped insulating body 12. Both ends of the insulating body 12 are sealingly closed by electrically conductive closure flanges 13 and 14. The insulating body 12, as indicated by the broken lines 15 also can be formed by a porcelain insulator.

As only schematically indicated there are connected with the closure flanges 13 and 14 the electrical connections 16 and 17 of the gas-blast switch 10. Connected with the closure flange 13 is a fixed contact body 18 which protrudes into the interior of the insulating housing 11. This fixed contact body 18, in turn, possesses a contact tube 19 serving as a power contact and a contact bushing 20 serving as a burn-off contact. The contact bushing 20 is arranged essentially coaxially with respect to the contact tube 19. This contact bushing 20 is secured by means of spoke-like struts 21 at the inside of the contact tube 19.

Secured to the closure flange 14 is a substantially cylindrical hollow body 23 formed of an electrically conductive material. At the central region of the closure flange 14 there is provided a throughpass opening or passageway 22. The end of the hollow body 23 which is remote from the flange 14 is closed by an end wall formed as a piston 24. This piston 24 and the jacket or shell 25 of the hollow body 23 thus surround a supply compartment or chamber 26, the function of which will be described more fully hereinafter.

Sealingly attached to the outside of the flange 14, by means of a connection sleeve or collar 27 is an electrically insulated support tube 28 which is in alignment with the throughpass opening 22. The support tube 28 is sealingly connected at its lower end by means of a connection sleeve or collar 29 at a merely schematically indicated drive housing 30.

Within the drive housing 30 there is arranged, for instance, a drive crank 31 which can be rocked in the direction of the double-headed arrow 33 about its shaft 32 by any suitable and therefore not further illustrated means. At the free end of the crank 31 there is articulated at location 34 a thrust and traction rod 35 formed of electrically insulating material. This thrust and traction rod 35 extends coaxially through the support tube 28, the opening 22, through the hollow body 23 which is open at the region of the opening 22 and through a bore 36 in the piston 24. At the upper end of the rod 35 there is attached the base or floor 38 of a pump cylinder 39 provided with the passageways 37. The inner space of the pump cylinder 39 between the piston 24 and the floor or base 38 thus constitutes a pump chamber 40 which is connected with the supply compartment or chamber 26 only by means of a nonreturn or suction valve 41 which is arranged at the piston 24 and opens in the direction of the pump chamber 40.

At the jacket or shell 42 of the pump cylinder 39 which surrounds the base or floor 38 there is attached a rim of resilient contact fingers 43, which, in the illustrated cut-on position engage at the outside of the contact tube 19. Furthermore, there is secured at the floor 38, at the side facing away from the piston 24, centrally thereof a contact pin 44 servng as a burn-off contact. This contact pin 44 engages into the bushing or sleeve 20. The passageways 37 in the cylinder floor 38 open into a blast nozzle 46 formed of electrically insulating material. This blast nozzle 46 is secured by means of an attachment ring 45 at the outside of the cylinder floor 38. The narrowest location or throat 47 of the blast nozzle 46, in the illustrated cut-on or switching-in position, so-to-speak sealingly encloses the outside of the bushing 20.

At the end region of the hollow body 23 which is remote from the piston 24 there are provided at its jacket or shell 25 the throughpass openings 48. However, these throughpass openings 48 do not open directly into the supply compartment or chamber 26. In fact, between the throughpass openings 48 and the supply compartment 26 there are arranged mutually parallel transverse walls 49, 50 in the hollow body 23. These transverse walls 49, 50 are alternately provided at the region of their periphery and at the region of their center, respectively, with throughpass openings or passages 51 and 52, respectively, so that gas only can flow out of the blast chamber 53 located externally of the pump cylinder 39 and the hollow body 23 along a labyrinth-like extending flow path into the supply compartment 26.

At the region which is furthest from the cylinder base or floor 38 there is secured at the periphery of the pump cylinder 39 a radially outwardly protruding impact plate 54. Between its periphery and the inner wall of the insulating body 12 there is provided a substantially ring-shaped or annular gap 55, so that both sections of the blast chamber 23 which are formed by the impact plate 54 communicate with one another by means of the throttle location formed by the ring-shaped gap 55. On the other hand, the inner space of the contact body 18 serving as an expansion space, communicates by means of window-like openings 57 with the upper section or portion of the blast chamber 53. Deflection blades or buckets 58, 59 engage through these openings 57. These deflection blades or buckets are secured, for instance, at the struts 60 or equivalent structure provided between the openings 57.

Now if there is accomplished a cut-off operation, then, by means of the crank 31 and the rod 35 the pump cylinder 39 together with the thereat attached contact fingers 43 and the contact pin 44 are downwardly drawn. Consequently, initially the contact fingers 43 come out of engagement with the contact tube 19. The gas in the pump chamber 40 experiences a precompression, since the blast nozzle 46 is still closed by the bushing element 20. As soon as the contact pin 44 has departed from the bore in the bushing element or sleeve 20 there is ignited an arc which is blown by the extinguishing or quenching gas flowing out under pressure from the pump chamber 40 by means of the now freed blast nozzle 46. This gas is forcefully heated and thus experiences a pressure increase. It expands past the struts 21 into the internal space or compartment 56 of the contact body 18 and from that location flows out through the openings 57 into the upper portion of the blast chamber 53. The gas flow is deflected in the direction of the impact plate 54 by the deflection blades 58, 59. The pressure surge formed in this upper portion of the blast chamber 53 propagates downwardly and impacts against the impact plate 54. Consequently, there is thus augmented the downward motion of the pump cylinder 39 and along therewith the cut-off movement. As long as this prevails there is continuously displaced further fresh gas out of the pump chamber 40 and guided through the blast nozzle 46 for blowing the arc.

The portion of the blast chamber 53 appearing at the lower region of the drawing functions to a certain degree as a "quietening chamber" in that the heated gas gradually flows from the upper portion of the blast chamber 53 and thus further cools.

It should be understood that depending upon the size of the width of the ring-shaped gap 55 the transverse walls 48 and 50 in the hollow body 23 also can be omitted. Also the piston 24 can be supported by columns upon the flange 14 so that the lower portion of the blast chamber 53 constitutes the actual supply compartment for the extinguishing or quenching gas from which there is sucked-up, during the course of the switching-in or cut-on stroke, cooled extinguishing gas into the pump chamber 40.

While the described gas-blast switch possesses power and burn-off contacts which are separated from one another it should be understood that the invention also can be employed in conjunction with such switches wherein the fixed and the movable contacts serve both for the transmission of power and also as the base point of the arc which is ignited during the cut-off operation.

While there are shown and described present preferred embodiments of the invention, it is to be distinctly understood that the invention is not limited thereto, but may be otherwise variously embodied and practiced within the scope of the following claims. Accordingly,

What I claim is:

1. A gas-blast switch comprising:

a gas tight electrically insulating housing;

said insulating housing defining a blast chamber therein;

a fixed contact surrounded by said blast chamber arranged within said insulating housing;

a movable contact arranged within said insulating housing;

a pump device;

a blast nozzle connected with said pump device and movable along with said movable contact;

said pump device comprising a pump cylinder movable in conjunction with said movable contact;

a stationary pump piston upon which there is displaceable said pump cylinder;

means operatively coupled with said pump cylinder and impinged by pressurized gas heated by the arc in order to augment the pumping stroke of the pump device; and said means coupled with said pump cylinder comprises an impact plate secured to the periphery of said pump cylinder and radially protruding therefrom.

2. The gas-blast switch as defined in claim 1, further including:

means defining a throttle location for communicating spaces to both sides of the impact plate with one another.

3. The gas-blast switch as defined in claim 1 wherein:

said impact plate is secured at an end region of the pump cylinder which is furthest from the blast nozzle.

4. The gas-blast switch as defined in claim 2, wherein:

said means defining a throttle location form a substantially ring-shaped gap between the periphery of the impact plate and an inner wall of the insulating housing.

5. The gas-blast switch as defined in claim 3, further including:

means defining a substantially ring-shaped gap between the periphery of the impact plate and an inner wall of the insulating housing.

6. The gas-blast switch as defined in claim 1, further including:

expansion compartment means operatively associated with the fixed contact and communicating by means of throughpassages with the blast chamber; and guide blades arranged at the region of the throughpassages between the expansion compartment means and the blast chamber for deflecting the gas flow upon passage through the throughpassages.

7. The gas-blast switch as defined in claim 5, wherein:

said means defining said ring-shaped gap includes said impact plate.

* * * * *